United States Patent [19]

Thoma et al.

[11] Patent Number: 5,064,510

[45] Date of Patent: Nov. 12, 1991

[54] METHOD FOR PRODUCING A GALVANICALLY DEPOSITED PROTECTION LAYER AGAINST HOT GAS CORROSION

[75] Inventors: Martin Thoma, Munich; Monika Bindl, Mitterscheyern; Josef Linska, Grafing, all of Fed. Rep. of Germany

[73] Assignee: MTU Motoren-und Turbinen-Union Muenchen GmbH, Munich, Fed. Rep. of Germany

[21] Appl. No.: 604,825

[22] Filed: Oct. 26, 1990

[30] Foreign Application Priority Data

Oct. 27, 1989 [DE] Fed. Rep. of Germany ..... 3935957

[51] Int. Cl.[5] ..... C25D 5/50; C25F 15/00

[52] U.S. Cl. ..... 204/16; 204/37.1; 204/48; 204/49

[58] Field of Search ..... 204/16, 37.1, 48, 49

[56] References Cited

U.S. PATENT DOCUMENTS 4,895,625 1/1990 Thoma et al. ..... 204/16

FOREIGN PATENT DOCUMENTS 2221921 2/1990 United Kingdom .

*Primary Examiner*—T. M. Tufariello

*Attorney, Agent, or Firm*—W. G. Fasse

[57] ABSTRACT

A method for producing a galvanically deposited protection layer against hot gas corrosion of a structural component, involves immersing the structural component in an electrolytic bath of a cobalt and/or nickel matrix material. Alloying chromium and/or aluminum particles are suspended in the electrolytic bath. Gas bubbles are mixed into the electrolytic bath, and the immersed structural component is rotated in the bath while the galvanic deposition or coating takes place. The bath is stationary and rotation of the structural component takes place about a substantially horizontal axis.

4 Claims, No Drawings

METHOD FOR PRODUCING A GALVANICALLY DEPOSITED PROTECTION LAYER AGAINST HOT GAS CORROSION

FIELD OF THE INVENTION

The invention relates to a method for galvanically depositing a protection layer on a structural component that needs to be protected against hot gas corrosion, e.g. turbine blades.

BACKGROUND INFORMATION

U.S. Pat. No. 4,895,625 (Thoma et al.) discloses a method for galvanically or electrolytically depositing a protective coating on a structural component, for example, gas turbine blades that must be protected against hot gas corrosion. The protection layer is produced by suspending in an electrolytic solution a metal alloy powder of which the particles have a spherical configuration and a passivated surface. The concentration of the particles in the electrolyte is preferably smaller than 100 g/l, whereby a high insertion rate of up to 45% by volume can be achieved at relatively low costs and small technical efforts. The electrolyte forming the bath includes a matrix material of cobalt and/or nickel in which the above mentioned chromium and/or aluminum spherical particles are suspended for deposition on the component with the matrix in the galvanic process. After a coating of sufficient thickness has been galvanically deposited a heat treatment is performed for alloying the metals to form the protective coating.

It is the main purpose in the earlier disclosure to achieve a uniform high quality protective coating at small effort and expense. Such a coating can be achieved when the insertion rate exceeds 40% by volume of the alloying powder suspended in the metal matrix. However, even after the galvanically deposited layer on the structural component has been properly subjected to the heat treatment to form the alloy in the coating, there remain quality differences in different surface areas.

Experience has now shown that unexpected, localized quality changes can take place in the coating, especially with regard to the uniformity of the coating thickness throughout the surface of the structural component, and also with regard to the insertion rate of the metal alloying powder in the galvanically deposited matrix material. For example, substantial insertion rate differences have been observed between the top surface and the bottom surface of the structural component. Similarly, differences in the insertion rate may occur between the top surface and the lateral surfaces of the structural component.

Comparing tests have shown that surprisingly, vertical surfaces of structural components inserted into an electrolytic bath have a small insertion rate below 10% by volume of the metal alloying powder. This phenomenon has been observed even if the electrolytic bath itself is being rotated and even if gas bubbles are caused to flow through a stationary electrolytic bath.

Tests with structural components arranged predominantly horizontally in the electrolytic bath have shown that the downwardly facing surfaces of the components also had an insertion rate of the alloying powder smaller than 10% by volume of the metal alloying powder.

OBJECTS OF THE INVENTION

In view of the above it is the aim of the invention to achieve the following objects singly or in combination:

- to achieve a uniform insertion rate of the alloying metal powder particles into the matrix material on all surface areas of the structural component to be protected;
- to avoid a microscopic agglomeration of metal alloy powder particles in the metal matrix material to be deposited in the galvanic bath on the component surfaces;
- to avoid a partial thinning of the metal alloy powder particles in the galvanically deposited layer on individual surface areas;
- to assure the distribution of the metal alloying powder particles in the matrix material to such an extent that the insertion rate exceeds 40% by volume of the metal alloying powder particles uniformly in the layer on all component surfaces; and
- to achieve a uniform coating layer thickness throughout all surface areas of the structural component to thereby minimize layer thickness variations.

SUMMARY OF THE INVENTION

The above objects have been achieved by making sure that the structural components to be coated are arranged horizontally with their surface areas to be coated in a stationary electrolytic bath into which gas bubbles are being mixed, and that the structural components are rotated about a horizontal axes while they are immersed in the electrolytic bath. The present improvement over the above described prior art has the advantage that the insertion rate and the layer thickness is now uniform and there are no differences in the insertion rate and layer thickness between structural component surfaces on a top side and downwardly facing surfaces of the structural component.

The r.p.m. of the rotation of the structural component should be between 2 to 10 revolutions per minute (r.p.m.) while the galvanic deposition takes place. This r.p.m. range has the advantage that periodically occuring microscopic insertion rate differences between upper and lower surface areas are avoided. Such differences can occur when the r.p.m. is less than 2. Furthere, a reduction of the insertion rate below 40% by volume does not occur as long as the r.p.m. does not exceed 10 r.p.m.

Gases suitable for mixing with the stationary galvanic bath may be selected from the following group nitrogen, argon or any other inert gas.

According to a preferred embodiment of the invention, the nickel and cobalt forming the matrix material should be present in the electrolyte so that the deposited matrix material is within a stoichiometric mol ratio of 1:1 (cobalt to nickel).

Comparing tests have shown unexpected advantages of the just mentioned stoichiometric deposition of nickel to cobalt as compared to a pure cobalt matrix deposition. Where the matrix contained cobalt and nickel in the above mentioned stoichiometric ratio the deposition rate could be more than doubled because it was found that, surprisingly, the critical current density at which the layer quality is diminishing again, could be more than doubled. Where a pure cobalt matrix deposition is involved, it was not possible to double the critical current density because the insertion rate of alloying metal powder was reduced and exposed areas of the structural component, such as edges, tips, curved portions, or ridges exhibited rough surface areas as compared to other surface zones. The invention avoids such rough surface areas.

DETAILED DESCRIPTION OF A PREFERRED EXAMPLE EMBODIMENT AND OF THE BEST MODE OF THE INVENTION

The current density in an electrolytic bath containing a cobalt nickel matrix material is preferably within the range of 500 to 800 A/m$^2$. Such a current density permits achieving advantageously a high deposition rate expressed as a layer thickness within the range of 100μm/h to 150μm/h. The layer thickness variations have been observed to be smaller than 10% and the insertion rate of alloying metal powder has been increased to 45% by volume.

The electrolytic bath composition was as follows:

| | |
|---|---|
| 320 g/l | $NiSO_4.6H_2O$ |
| 30 g/l | $CoSO_4.6H_2O$ |
| 50 g/l | $NiCl_2.6H_2O$ |
| 35 g/l | $H_3BO_3$ |
| 20 g/l | CrAlY (metal alloying powder having a particle size smaller than 10 μm) |

A turbine blade was mounted for rotation about its longitudinal axis while being immersed in the above electrolytic bath and while the rotational axis extended horizontally. The blade was rotated at 10 r.p.m. The controlled direct current density in the bath was maintained at 800 A/m$^2$. Within 60 minutes the deposited layer had the following characteristics. The matrix material contained 50 mol% of cobalt, and 50 mol% of nickel. The inserted CrAlY particles in the matrix material had the following composition: 71 mol% of chromium, 27 mol% of aluminum, and 2 mol% of yttrium in a uniform layer thickness on the upper and underside of the turbine blade. The layer thickness was 140μm±10μm with a uniform insertion rate of 45% by volume of the CrAlY particles, in all surface areas.

In order to improve the layer quality, wetting agents, base brightener agents, or other brightening additives may be used in the galvanic bath. In the above example the following layer quality improving additives were used in the galvanic bath: 0.4 g/l of ortho sulfimide benzoic acid (saccharin); 0.2 g/l of butene-(2)-diol (1.4), and 3 ml/l of sodium lauryl sulfate, After the galvanic deposition the turbine blade with coating was subjected to a heat treatment at 1050° C. for 15 hours for diffusing the matrix element cobalt and nickel within each other and the CrAlY particles into the surfaces areas of the layer, as well as into the surface of the blade alloy. The turbine blade was made of an alloy having the following composition:

| | |
|---|---|
| 0.15% | carbon |
| 10.0% | chromium |
| 15.0% | cobalt |
| 3.0% | molybdenum |
| 4.7% | titanium |

-continued

| | |
|---|---|
| 5.5% | aluminum |
| 0.05% | zirconium |
| 0.015% | boron |
| 1.0% | vanadium |
| rest | nickel |

In another example the successfully coated turbine blade was made of an alloy having the following composition:

| | |
|---|---|
| 9.0% | chromium |
| 5.0% | cobalt |
| 9.5% | tungsten |
| 2.9% | tantalum |
| 0.7% | niobium |
| 5.5% | aluminum |
| 1.8% | titanium |
| 0.03% | carbon |
| rest % | nickel |

Although the invention has been described with reference to specific example embodiments it will be appreciated that it is intended to cover all modifications and equivalents within the scope of the appended claims.

What we claim is:

1. A method for galvanically depositing a protective coating on a structural component intended for exposure to hot gas, comprising the following steps:

(a) preparing an electrolyte in which a matrix material of cobalt and/or nickel is contained, (b) providing an alloying powder containing at least one component selected from the group consisting of aluminum, chromium, and yttrium, said alloying powder having powder particles of a substantially spherical configuration with a passivated surface, (c) suspending said spherical powder particles in said electrolyte, (d) introducing gas bubbles into a stationary electrolytic bath holding said electrolyte, (e) immersing said structural component in said stationary electrolytic bath with said gas bubbles therein and rotating said structural component about a substantially horizontal axis while said structural component is immersed in said electrolytic bath, until said structural component has a coating of a desired thickness, and (f) removing the coated structural component from said electrolytic bath and subjecting the coated structural component to a heat treatment until an alloyed coating is formed.

2. The method of claim 1, wherein said rotating of the immersed structural component in said electrolytic bath is performed at an r.p.m. within the range of 2 to 10 revolutions per minute about a horizontal axis.

3. The method of claim 1, wherein cobalt and nickel of said matrix material are present in said electrolyte sufficient for depositing a stoichiometric mol ratio of 1:1 of nickel to cobalt in said coating.

4. The method of claim 1, wherein a current density in said electrolytic bath is within the range of 500 to 800 Ampere/m$^2$.

* * * * *